US010518428B2

(12) United States Patent
Halmut et al.

(10) Patent No.: US 10,518,428 B2
(45) Date of Patent: Dec. 31, 2019

(54) HAIR TRIMMER WITH CUTTING GUIDE

(71) Applicant: KONINKLIJKE PHILIPS N.V., Eindhoven (NL)

(72) Inventors: Ishay Halmut, Eindhoven (NL); Jeroen Christian Nijdam, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 26 days.

(21) Appl. No.: 15/889,486

(22) Filed: Feb. 6, 2018

(65) Prior Publication Data

US 2018/0161997 A1 Jun. 14, 2018

Related U.S. Application Data

(62) Division of application No. 14/236,355, filed as application No. PCT/IB2012/053775 on Jul. 25, 2012, now Pat. No. 9,902,076.

(60) Provisional application No. 61/525,875, filed on Aug. 22, 2011.

(51) Int. Cl.

| | |
|---|---|
| ***B26B 19/46*** | (2006.01) |
| ***B26B 19/38*** | (2006.01) |
| *B26B 19/20* | (2006.01) |

(52) U.S. Cl.

CPC ..... *B26B 19/46* (2013.01); *B26B 19/382* (2013.01); *B26B 19/20* (2013.01); *B26B 19/3813* (2013.01)

(58) Field of Classification Search

CPC ..... B26B 19/46; B26B 19/06; B26B 19/382
See application file for complete search history.

(56) References Cited

U.S. PATENT DOCUMENTS

| | | | | |
|---|---|---|---|---|
| 233,695 | A | 10/1880 | Priest | |
| 929,549 | A | 7/1909 | Campanello | |
| 1,086,799 | A | 2/1914 | Accisano | |
| 1,245,833 | A | 11/1917 | Vass | |
| 1,246,734 | A | 11/1917 | Flick | |
| 1,366,721 | A | 1/1921 | Vincenzo | |
| 2,262,392 | A * | 11/1941 | Dalkowitz | B26B 19/46 30/34.05 |
| 2,381,046 | A | 8/1945 | Adelmlo | |
| 2,593,168 | A | 4/1952 | Monyhan | |
| 2,722,741 | A | 11/1955 | McAuliffe | |
| 2,802,263 | A | 8/1957 | Marchner | |
| 2,916,820 | A | 12/1959 | Clark | |
| 3,885,306 | A | 5/1975 | Herman | |
| 4,428,124 | A | 1/1984 | Asakura | |
| 5,054,199 | A | 10/1991 | Ogawa | |

(Continued)

FOREIGN PATENT DOCUMENTS

| | | | |
|---|---|---|---|
| CH | 218156 A * | 11/1941 | B26B 19/46 |
| CN | 201792358 U | 4/2011 | |

(Continued)

OTHER PUBLICATIONS

English translation of DE965682. (Year: 1957).*
English Translation of FR1271458 (Year: 1961).*

*Primary Examiner* — Jennifer B Swinney

(57) ABSTRACT

A hair cutting device comprises a blade portion and an adjustable cutting guide moveable with respect to the blade portion to provide a reference guide line on a user's skin/body to enable hair to be cut accurately at a predetermined angle or pattern.

16 Claims, 14 Drawing Sheets

(56) References Cited

U.S. PATENT DOCUMENTS

| | | | | | |
|---|---|---|---|---|---|
| 5,970,616 | A * | 10/1999 | Wahl | B26B 19/063 30/199 |
| 2004/0139615 | A1 | 7/2004 | Gianatasio | |
| 2004/0194316 | A1 * | 10/2004 | Lin | B26B 19/38 30/34.05 |
| 2009/0000125 | A1 | 1/2009 | Peyser et al. | |

FOREIGN PATENT DOCUMENTS

| | | | | | |
|---|---|---|---|---|---|
| DE | 965682 | C * | 6/1957 | | B26B 19/46 |
| DE | 2117663 | A1 * | 10/1972 | | B26B 19/46 |
| DE | 10205247 | A1 * | 8/2003 | | B26B 19/46 |
| FR | 897139 | A * | 3/1945 | | B26B 19/46 |
| FR | 1271458 | A * | 9/1961 | | B26B 19/46 |
| FR | 1516103 | A * | 3/1968 | | B26B 19/46 |
| FR | 2105569 | A1 | 4/1972 | | |
| FR | 2105569 | A5 * | 4/1972 | | B26B 19/46 |
| FR | 2188485 | A5 * | 1/1974 | | B26B 19/46 |
| FR | 2198402 | A5 * | 3/1974 | | B26B 19/46 |
| WO | 2007044461 | A1 | 4/2007 | | |
| WO | 2008010153 | A1 | 1/2008 | | |

* cited by examiner

HAIR TRIMMER WITH CUTTING GUIDE

CROSS-REFERENCE TO RELATED APPLICATION

The present application is a divisional of U.S. patent application Ser. No. 14/236,355, filed Jan. 31, 2014, now U.S. Pat. No. 9,902,076 issued Feb. 27, 2018, which is the U.S. National Phase application under 35 U.S.C. § 371 of International Application No. PCT/IB2012/053775, filed on Jul. 25, 2012, which claims the benefit of U.S. Provisional Application No. 61/525,875 filed on Aug. 22, 2011. These applications are hereby incorporated by reference herein.

FIELD OF THE INVENTION

The present invention relates to the field of hair cutting devices and, more specifically, to devices with a hair cutting guide.

BACKGROUND OF THE INVENTION

Grooming devices exist for cutting body and facial hair. Such devices are known as 'trimmers' and typically comprise a set of fixed blades and an adjacent set of moving blades that oscillate from side to side relative to the fixed blades to sever hair protruding between the two sets of blades. Such a device is disclosed in US 2004/139615. When using such devices, it can be difficult for a user to trim hair, especially facial hair, with precision in order to create a desired hair style, and to mirror the style from one side of the face to the other. The trimming device disclosed in US 2004/139615 partly aims to resolve this by providing a spirit level incorporated into the body of the trimmer so that the cutting blades can be held horizontal.

One problem with the hair cutting/trimming device disclosed in US 2004/139615 is that it only enables a user to accurately cut hair in a horizontal line. Furthermore, when being used to cut facial hair, the accuracy with which the cut style is replicated on both sides of the user's face is dependent on the user maintaining their face level when cutting both sides.

A hair cutting device is disclosed in EP 2040893 comprising a shaving razor having a light source which is configured to project a light line on a user's skin to indicate the exact location of a blade of the razor to enable alignment of the blade edge during shaving. Although the light line allows a user to see where the blade will contact his face, the device of this document does not enable a user to accurately cut hair in a desired pattern or style relative to any reference points on the user's face or body, nor does the device provide any means to allow a user to mirror a hair style cut on one side of a user's face to the other side.

SUMMARY OF THE INVENTION

It would be advantageous to provide a device for cutting hair that substantially alleviates or overcomes at least one of the problems mentioned above.

According to the present invention, there is provided a device for cutting hair comprising a body portion including a handle, a cutting blade assembly, and an adjustable cutting guide, wherein the position of the cutting guide can be adjusted to a chosen angle relative to the cutting blade to provide a reference line on the user's skin to enable hair to be cut at said angle relative to the reference line.

The device may comprise a hair trimmer, or may comprise a shaver with a hair trimmer unit. Such a shaver may comprise a shaving head and the cutting blade assembly mentioned above may comprise the trimmer unit separate to the shaving head.

The cutting guide may comprise a first cutting guide member configured to be arranged at an angular position relative to the cutting blade assembly, which can enable a user to align the cutting guide member with a reference feature on the skin/body so that hair can be cut at the selected angle relative to the guide member. The first cutting guide member may be pivotally mounted to a support member.

The device may further comprise a second cutting guide member pivotally mounted to the first cutting guide member. The second cutting guide member may be provided on an opposite end of the first cutting guide member to the point at which the first cutting guide member is mounted to the support member. Such an embodiment with first and second cutting guide members would afford a user a greater variety of reference guide positions to enable a wider range of hair cutting angles to be achieved.

The support member may include a rotatable platform and the cutting guide member may be pivotally mounted on the rotatable platform. This would enable a user to switch the orientation of the cutting guide while maintaining the angular position of the cutting guide member, for example, when mirroring a style cut on one side of the face/body to the other.

The cutting blade may comprise a row of cutting teeth and the first cutting guide member may be moveable in a plane perpendicular to the row of the cutting teeth.

The cutting guide may be detachably mounted on the body portion or on the cutting blade. This provides the advantage of flexibility, enabling a user to choose to use the hair cutting device with or without the cutting guide, and so use the cutting guide only when required. Furthermore, the cutting guide may be configured to be attachable to the body portion or cutting blade assembly in a plurality of different orientations. This can allow a user to more easily recreate a style from one side of the body/face to the other.

The device may further comprise a locking mechanism to enable the cutting guide to be locked in the chosen angular position relative to the cutting blade. Such a locking mechanism can ensure that the cutting guide remains at the selected position during use to ensure hair is cut at a constant and chosen angle/pattern.

The cutting guide may alternatively comprise a first light source to project a first light beam onto a user's skin as said reference line and, the first light source may be moveable so that the angle of the first light beam relative to the cutting blade can be adjusted to the chosen angle. The first light beam may comprise a reference shape to be projected on the user's face, such as circle sector, and the shape may be variable in configuration to vary the reference line thereof, for example to vary the angle of the circle sector. This can provide an easily visible reference line without any guide member physically touching the user's skin/body, and enables the angle of the light beam to be adjusted. The angle of the first light beam relative to the cutting blade may be adjustable within a range of angles that includes zero degrees to the cutting blade assembly (i.e. parallel thereto) or alternatively, may be adjustable within a range of angular positions relative to the cutting blade assembly that excludes being parallel to, or exactly aligned with, the cutting blade assembly.

The device may further comprise a second light source, which may be fixed relative to the cutting blade, to project a second light beam parallel to the cutting blade such that the first and second light beams intersect to define a cross-hair reference point for a hair cutting operation. Such a pair of reference beams provides the advantage that particular hair or facial features can be aligned with the respective beams and intersection point to further enhance hair cutting accuracy.

The second light source may be configured to project the second light beam onto the user's skin at a cutting line where hair is cut by the cutting blade assembly. Alternatively, the second light source may be configured to project the second light beam onto a user's skin parallel to, but spaced forwards from, a cutting line where hair is cut by the cutting blade assembly.

The first light source may be incrementally moveable between chosen angular positions, to provide predetermined positions thereof, and to also enable exact replication of cutting angle/orientation between separate uses of the device.

The cutting guide may include a rotary control actuator to control the angular position of the first light source. This could enable easy manipulation of the cutting guide by a user to the desired position.

Also provided is a method of cutting hair using hair cutting a device having a body portion including a handle, a cutting blade assembly and an adjustable cutting guide, the method comprising adjusting the position of the cutting guide to a chosen angle relative to the cutting blade assembly to provide a reference line on the user's skin, aligning the reference line to a chosen reference feature on the user's skin/body, and cutting the user's hair at said chosen angle relative to the reference line.

The method may further comprise aligning a guide member with the chosen reference feature on the user's skin/body. Alternatively, the method may further comprise aligning a first light beam of a first light source with the chosen reference feature on the user's skin/body.

The method may further comprise locking the cutting guide in the chosen angular position relative to the cutting blade using a locking mechanism on the cutting guide.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
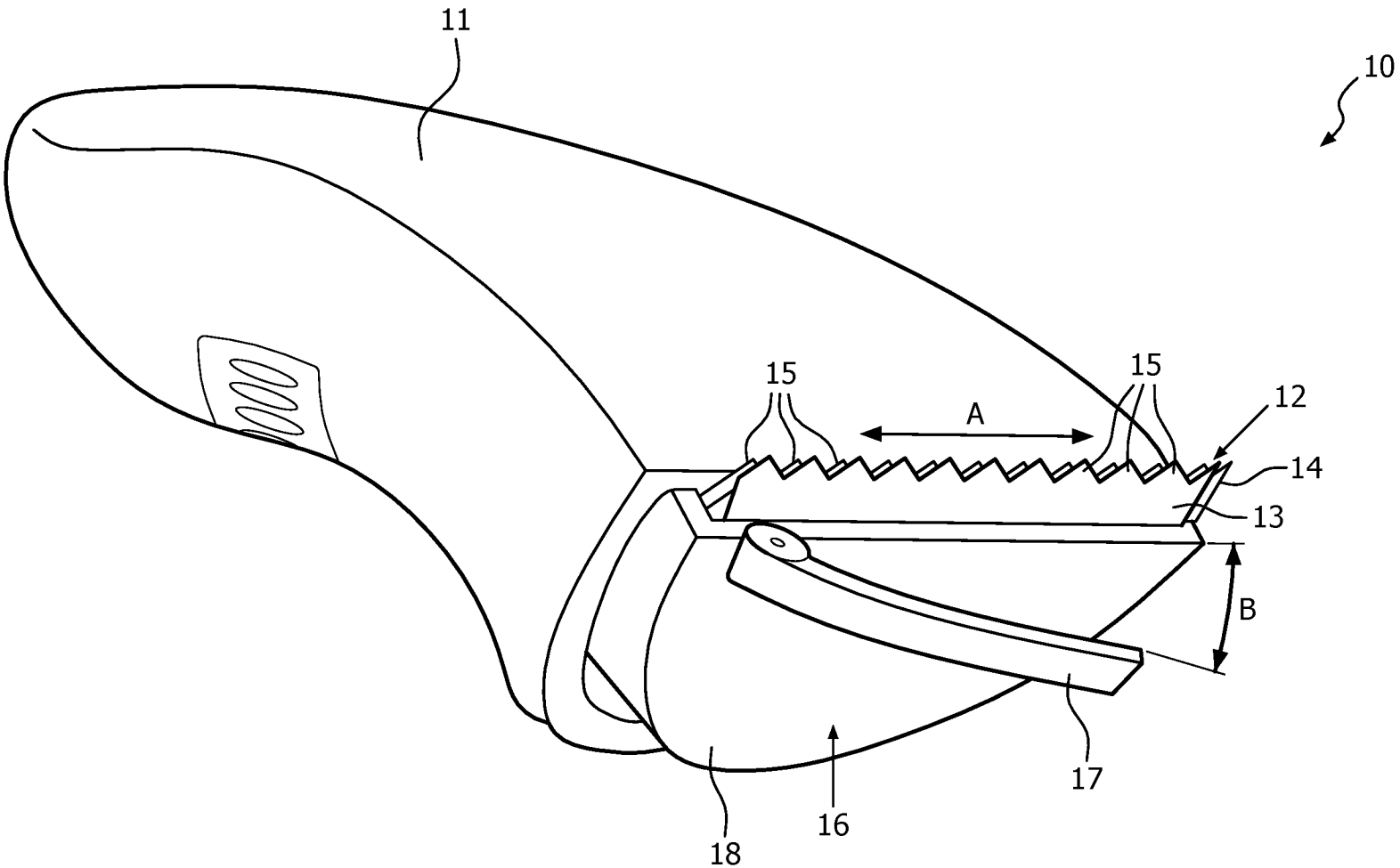
FIG. 1 shows a perspective view of a hair trimming device of a first embodiment of the invention.
Figure 2:
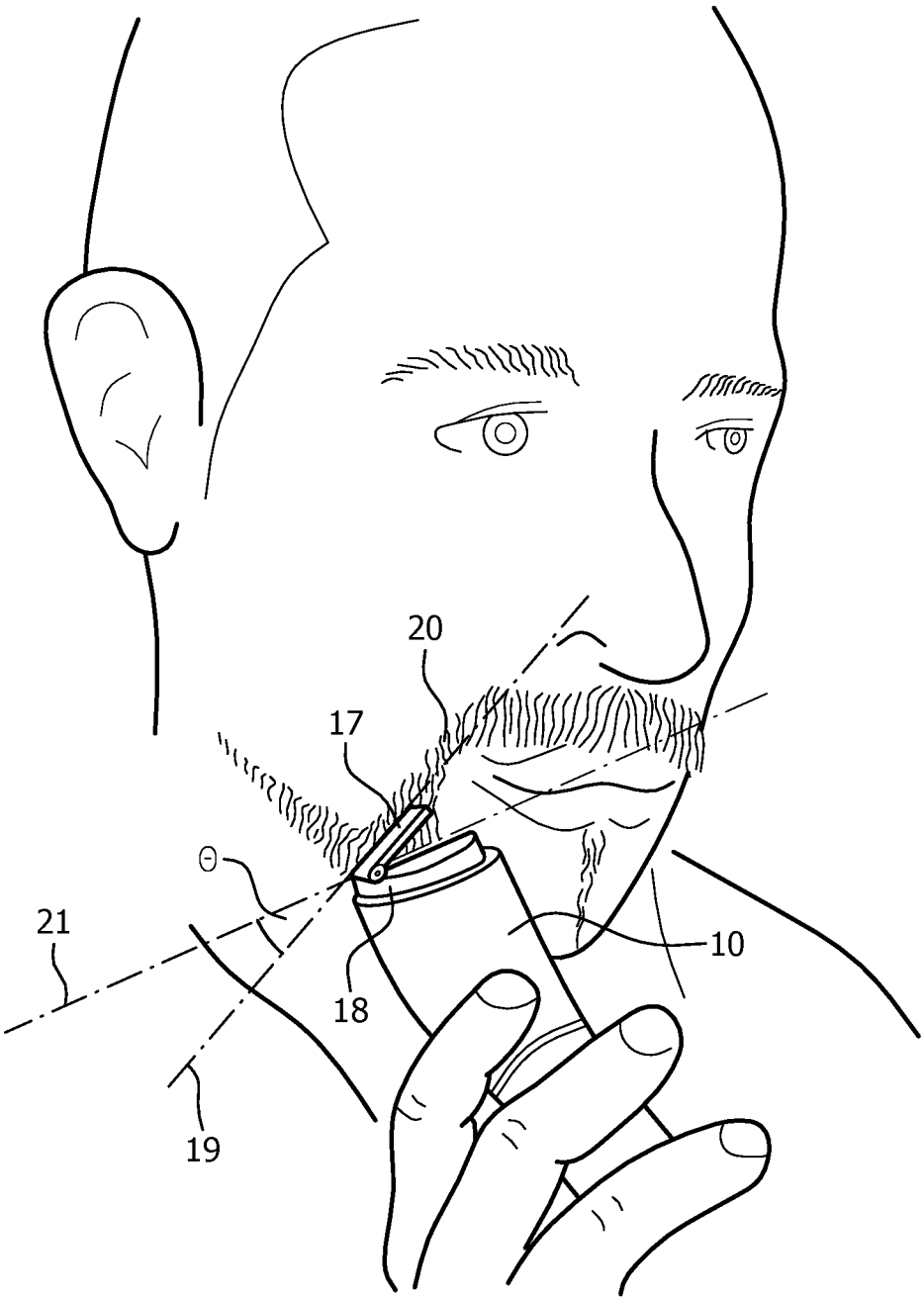
FIG. 2 shows the device of FIG. 1 in operation by a user.

Referring to FIGS. 1 and 2, there is shown a device 10 for cutting and trimming hair, such as, but not limited to, facial or body hair, which comprises a body portion 11 and a blade portion 12. The blade portion 12 comprises a fixed blade plate 13 and moving blade plate 14. The moving blade plate 14 lies adjacent the fixed blade plate 13 and, in use, is driven by a motor (not shown) to oscillate back and forth across the fixed blade plate 13, as shown by arrow 'A' in FIG. 1. Each blade plate 13, 14 comprises a plurality of cutting teeth 15. Hair is cut by a shearing action as it protrudes between the teeth 15 of the two blade plates 13, 14.

A cutting guide 16 is provided and comprises a guide member in the form of an arm 17 pivotally mounted to a support cover 18 which is detachably secured at the end of the device 10 proximate the blade portion 12. The arm 17 is configured to pivot towards and away from the blade portion 12, as shown by arrow B.

The cutting guide 16 enables a user to accurately trim hair at a predetermined angle relative to other reference features on the skin/body, the angle being determined by the position of the arm 17 relative to the blade portion 12. The device is shown in operation by a user in FIG. 2, where it can be seen that the arm 17 is pivoted away from the blade portion 12. The user can then align the arm 17 to a reference line 19 corresponding with a feature of the user's face, such as ears, nose, mouth, etc., or as shown in FIG. 2, the downward part 20 of the user's moustache, and the blade portion 12 can then accurately cut the hair along a cutting line 21, corresponding to the teeth 15 of the cutting blades 13, 14, at the predetermined angle θ relative to the reference line 19. Furthermore, the user can easily replicate the exact hair cutting pattern on the other side of his face using the arm 17 set at the same predetermined angle θ relative to the blade portion 12, thereby achieving a symmetrical pattern/style on either side of his face. The arm 17 is aligned with the corresponding reference line 19 of the downward part 20 of the other side of the user's moustache and the blade portion 12 can accurately cut the hair along a cutting line 21 at the predetermined angle θ relative to the reference line 19.

The arm 17 may include a frictional resistance in its movement to prevent the arm 17 moving from its chosen position in use. Furthermore, the arm 17 may include an alternative form of mechanical or electric locking system to keep it in the chosen angular position and prevent the arm 17 from moving in use.

Figure 3:
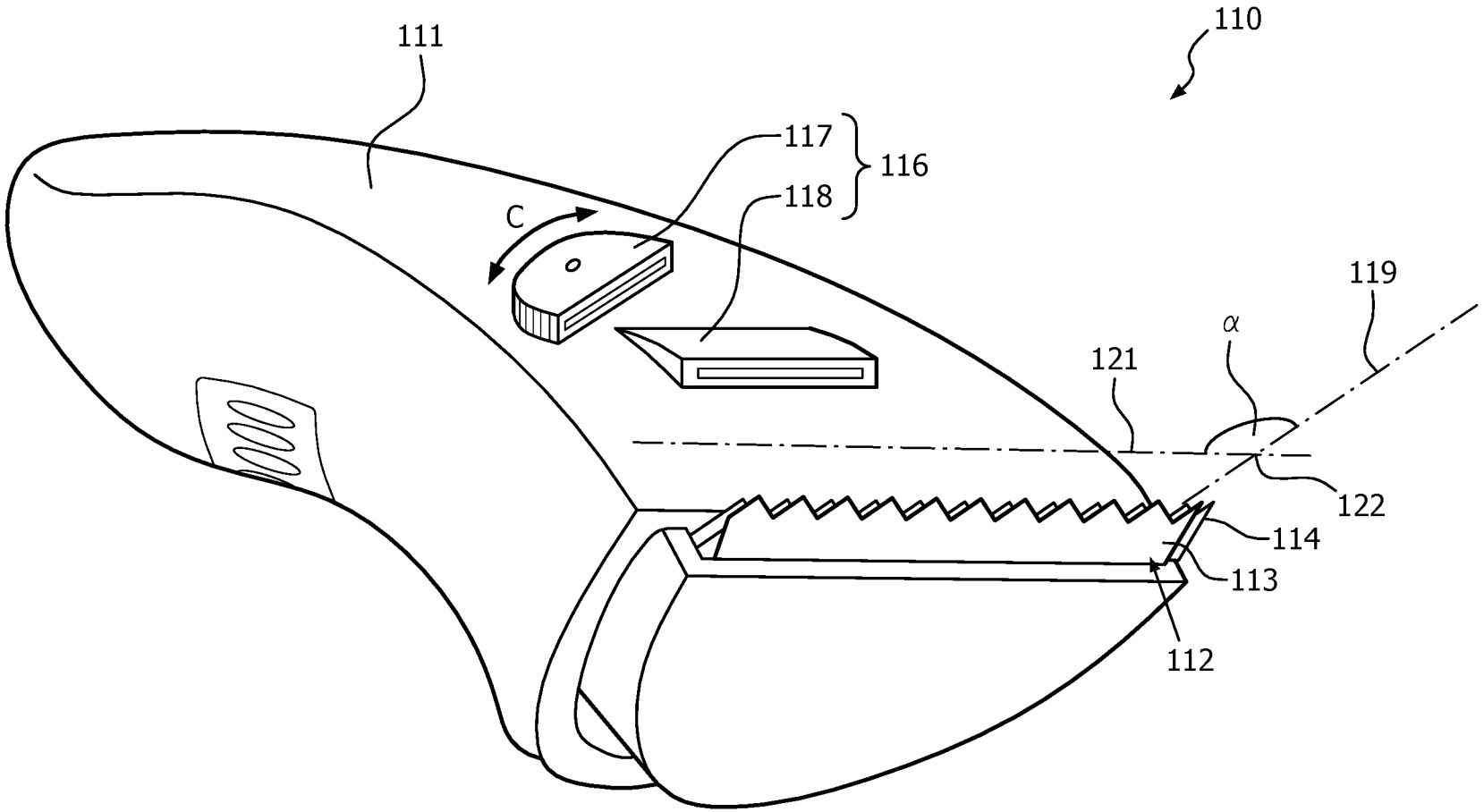
FIG. 3 shows a perspective view of a hair trimming device of a second embodiment of the invention.

A hair cutting/trimming device 110 of a second embodiment of the invention is shown in FIG. 3 and comprises a body portion 111 and a blade portion 112. The blade portion 112 comprises a fixed blade plate 113 and moving blade plate 114 as described above with reference to the device 10 of the first embodiment of the invention, and so a detailed description of these features will not be repeated.

The device 110 of the second embodiment of the invention is provided with a cutting guide 116, but of a different construction to that of the device 10 of the first embodiment described above. The cutting guide 116 of the device 110 of the second embodiment of the invention uses light beams to indicate an intended hair cutting position on a user's skin/body, as described in more detail below.

The cutting guide 116 comprises a first light source 117 and a second light source 118. The first light source 117 is pivotally mounted on the body portion 111 and is rotatable as shown by arrow 'C' in FIG. 3. The second light source 118 is fixedly mounted on the body portion 111. The first light source 117 projects an adjustable reference beam 119 at an angle α relative to the blade portion 112, said angle α determined by the chosen rotated position of the first light source 117. The second light source 118 is configured to project a fixed reference beam 121 parallel to the cutting edges of the blade plates 113, 114 of the blade portion 112. In the embodiment shown, this fixed reference beam 121 is spaced forwards of the cutting edges of the blade portion 112, although it is intended within the scope of the invention that the fixed reference beam may be projected coincident with a cutting line on a users skin where the blade portion 112 cuts the hair. The two reference beams 119, 121 intersect at a 'cross-hair' reference point 122.

Figure 4:
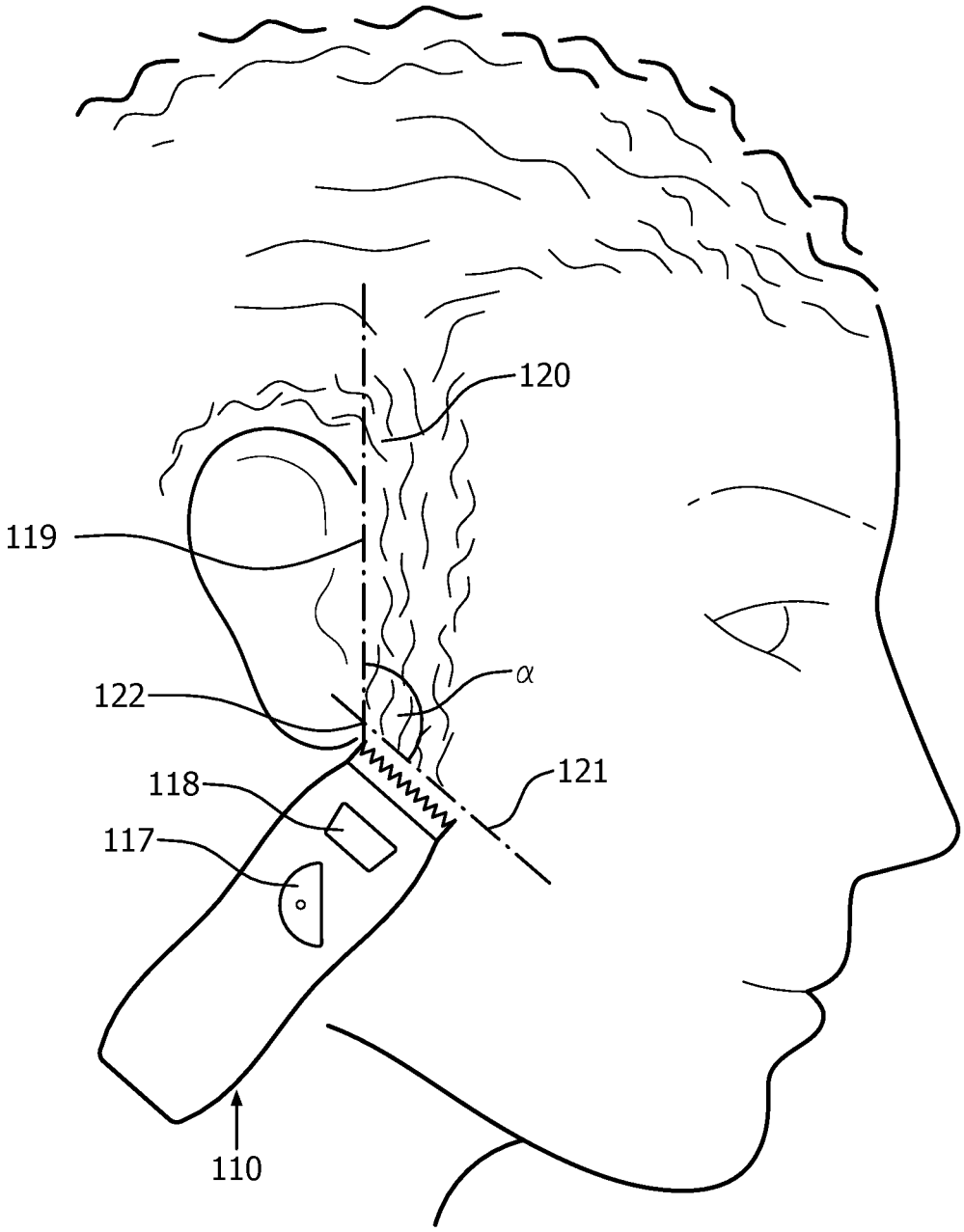
FIG. 4 shows the device of FIG. 3 in operation by a user.

The cutting guide 116 enables a user to accurately trim hair at a predetermined angle α relative to other reference features on the skin/body. The device 110 is shown in operation by a user in FIG. 4, where it can be seen that the first light source 117 is pivoted so that the adjustable reference beam 119 makes an angle α with the fixed reference beam 121, and therefore with the blade plates 113, 114 of the blade portion 112. The user can then align the adjustable reference beam 119 to a feature of the user's face, in this case the vertical part 120 of the user's sideburn, and the blade portion 112 can then accurately cut the hair at the predetermined angle α relative to the adjustable reference beam 119. The user can also ensure the correct cut position by aligning the cross-hair 122 at the point at which the vertical edge 120 of the user's sideburn meets the angled bottom part. Furthermore, the user can easily replicate the exact hair cutting pattern on the other side of his face by setting the first light source 117 to a rotated position of the same predetermined angle α relative to the blade portion 112, but inclined in the opposite direction. Thus, a symmetrical hair pattern/style can be achieved on either side of his face.

The first light source 117 may be configured with an incremental rotating movement with a plurality of set stable positions of varying angles relative to the blade portion 112/fixed reference beam 121. Furthermore, the set stable positions may be provided symmetrically about a central 'zero' position at which the adjustable reference beam 119 lies parallel to the fixed reference beam 121. This would enable the user to easily recreate the same cutting angle from one side of a face to the other. The first light source 117 may be configured as a dial or other easily manipulated actuator for adjustment of the angle thereof.

The first and second light sources 117, 118 can be any light source capable of projecting a defined beam or line of light, and may comprise a laser light source within the scope of the invention.

Although the device 110 of the second embodiment of the invention is shown and described as having two light sources 117, 118 to project two reference beams 119, 121, it is intended within the scope of the invention that a hair cutting device may include just one light source, being an adjustable light source to project an adjustable reference beam at a chosen angle relative to the blade portion 112 of the device, and the second light source 118 that projects a beam on the user's face at a position forwards of, or coincident with where the blade portion 112 contacts the user's face, may be omitted. Furthermore, it is intended within the scope of the invention that in such an embodiment where only a single light source is provided, the beam projected may not necessarily be a straight line, but may comprise another shape having one or more angled surfaces, such as a sector of a circle, so that one line of the sector can be aligned with a reference feature on a user's face/body, and another line of the sector can lie parallel with the blade portion 112. In such an embodiment, the shape projected by the single light source may be variable by adjusting a control actuator on the device to vary the relative angles of the projected shape.

A device 210 for cutting hair according to a third embodiment of the invention is shown in FIGS. 5-9 and comprises a body portion 211 and a blade portion 212. The blade portion 212 comprises a fixed blade plate 213 and moving blade plate 214 as described previously and so a detailed description will not be repeated. A cutting guide 216 is provided which comprises a guide member 217 pivotally mounted to a support plate 218 at a hinge portion 219, and the support plate 218 is detachably held in a holder 220. The holder 220 itself is detachably secured at the end of the device 210 proximate the blade portion 212 (although it is intended within the scope of the invention that the holder 220 may be integrally formed with the device 210). The guide member 217 is configured to pivot towards and away from the support plate 218 about the hinge portion 219, and therefore is pivotable relative to the blade portion 212. The guide member 217 is shown pivoted away from the support plate 218 in FIG. 7.

Figure 5:
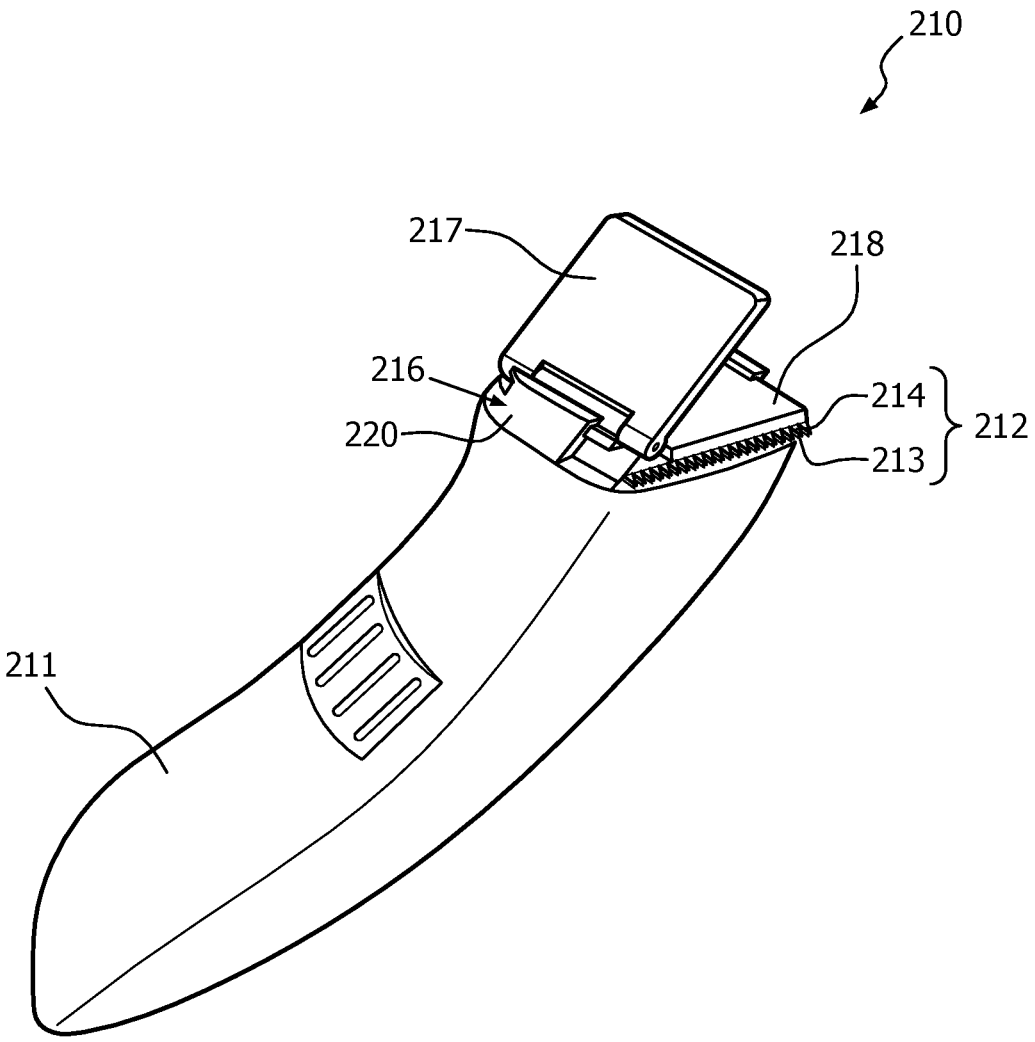
FIG. 5 shows a perspective view of a hair trimming device of a third embodiment of the invention.
Figure 6:
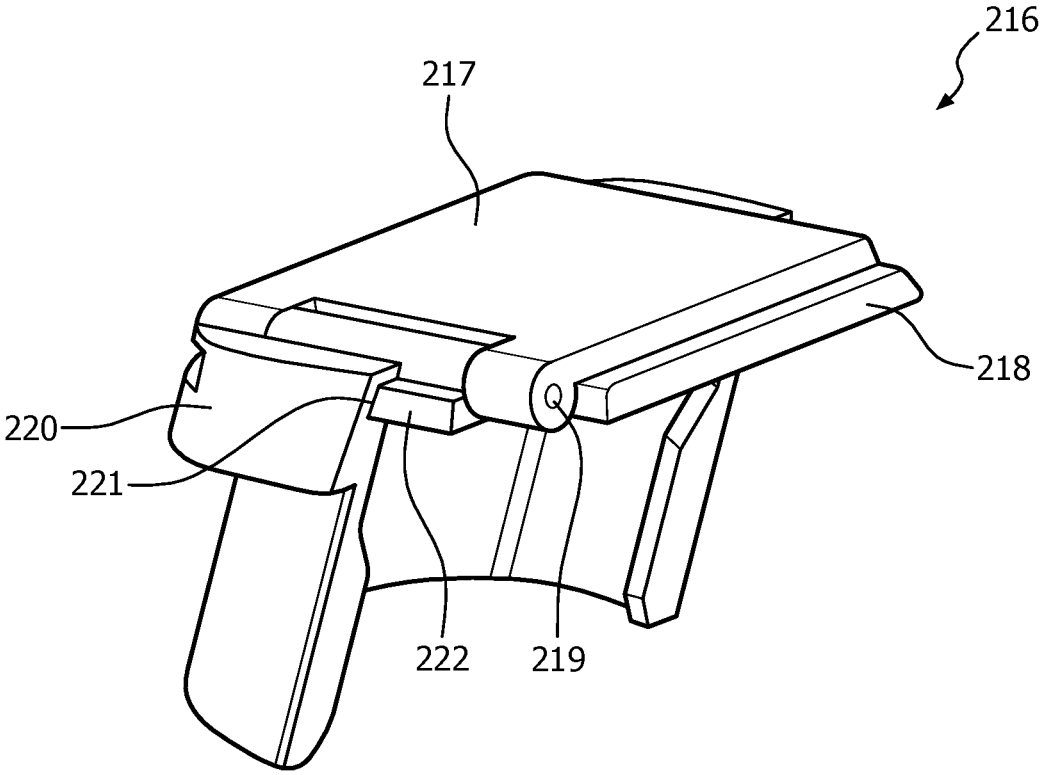
FIG. 6 shows a perspective view of the cutting guide of the device of FIG. 5.
Figure 7:
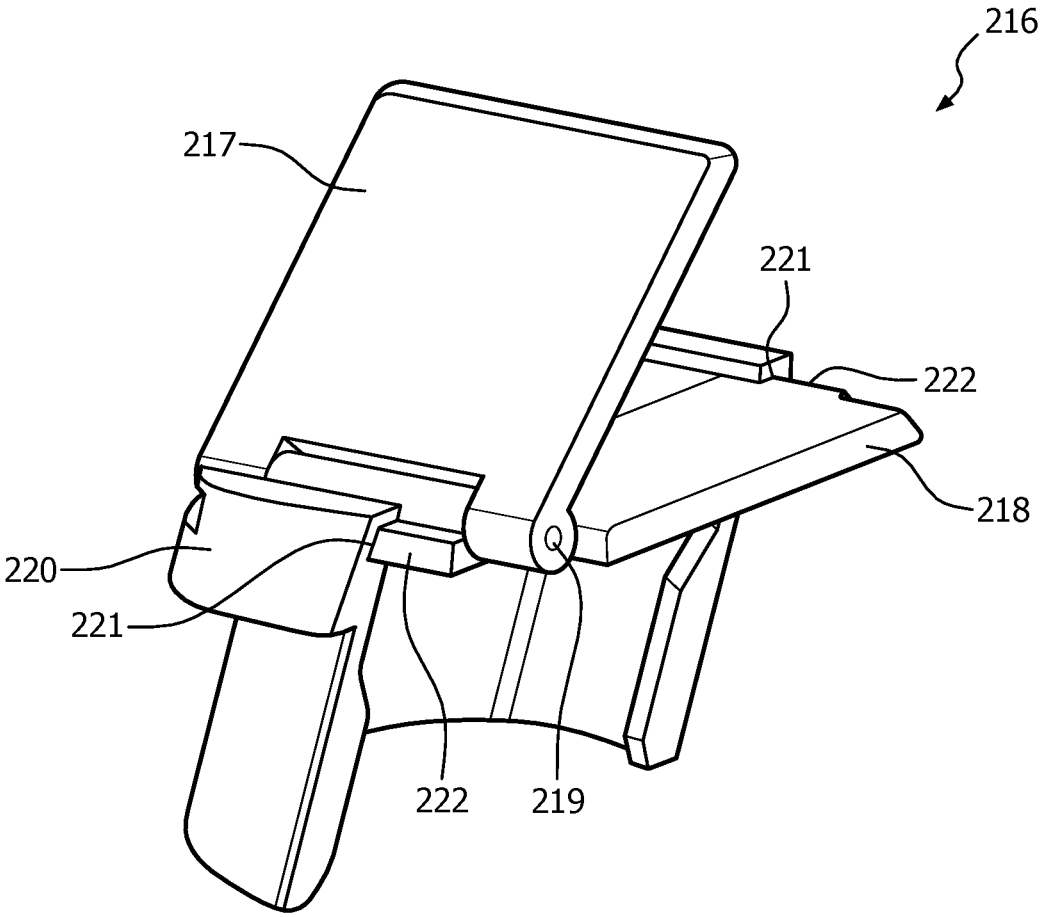
FIG. 7 shows the cutting guide of FIG. 6 in an extended angled position.
Figure 8:
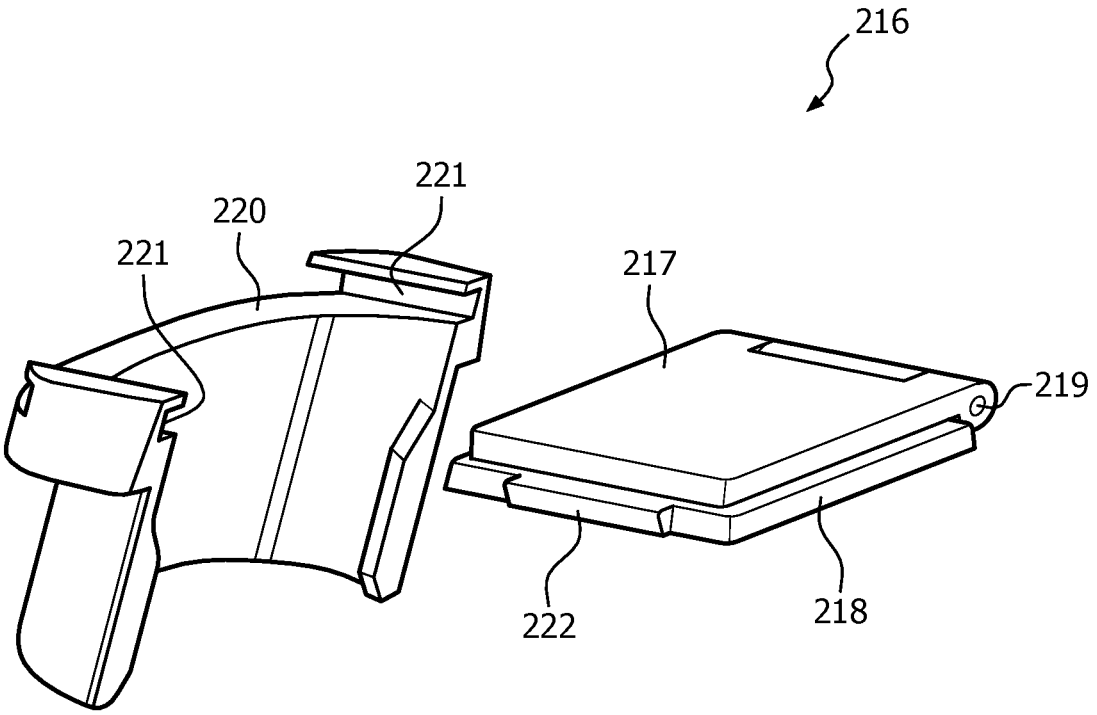
FIG. 8 shows the cutting guide of FIG. 6 separated and in an alternative orientation.
Figure 9:
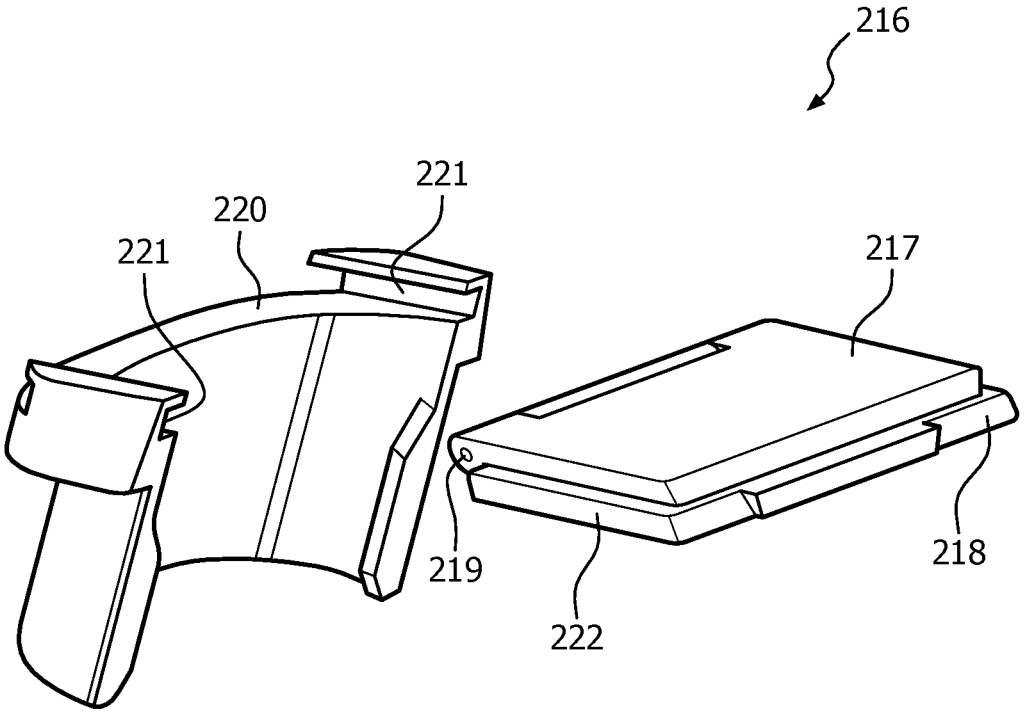
FIG. 9 shows the cutting guide of FIG. 6 separated and in a further alternative orientation.

The holder 220 includes two opposing slots 221 which receive opposite side edges 222 of the support plate 218, and the support plate 218 can be retained in the holder 220 in a number of different orientations. For example, FIGS. 5 to 7 show the support plate 218 retained in the holder 220 with the hinge portion 219 on the left side of the holder 220. However, FIG. 8 shows the support plate 218 removed from the holder 220 and rotated through 180 degrees, prior to being fitted back into the holder 220, so that the hinge portion 219 is on the right side of the holder 220. FIG. 9 shows the support plate 218 removed from the holder 220 and rotated through 90 degrees from the orientation in FIGS. 5-8, prior to being fitted back into the holder 220, so that the hinge portion 219 is at the rear of the holder 220.

The support plate 218 being removable from the holder 220 and rotatable so that the hinge portion 219 is on either the left or the right side allows a user to cut hair at a desired style on one side of the face/body, reverse the orientation of the support plate 218, keeping the guide member 217 at the chosen angle, then accurately mirror the hair cut style on the other side of the face/body.

Figure 10:
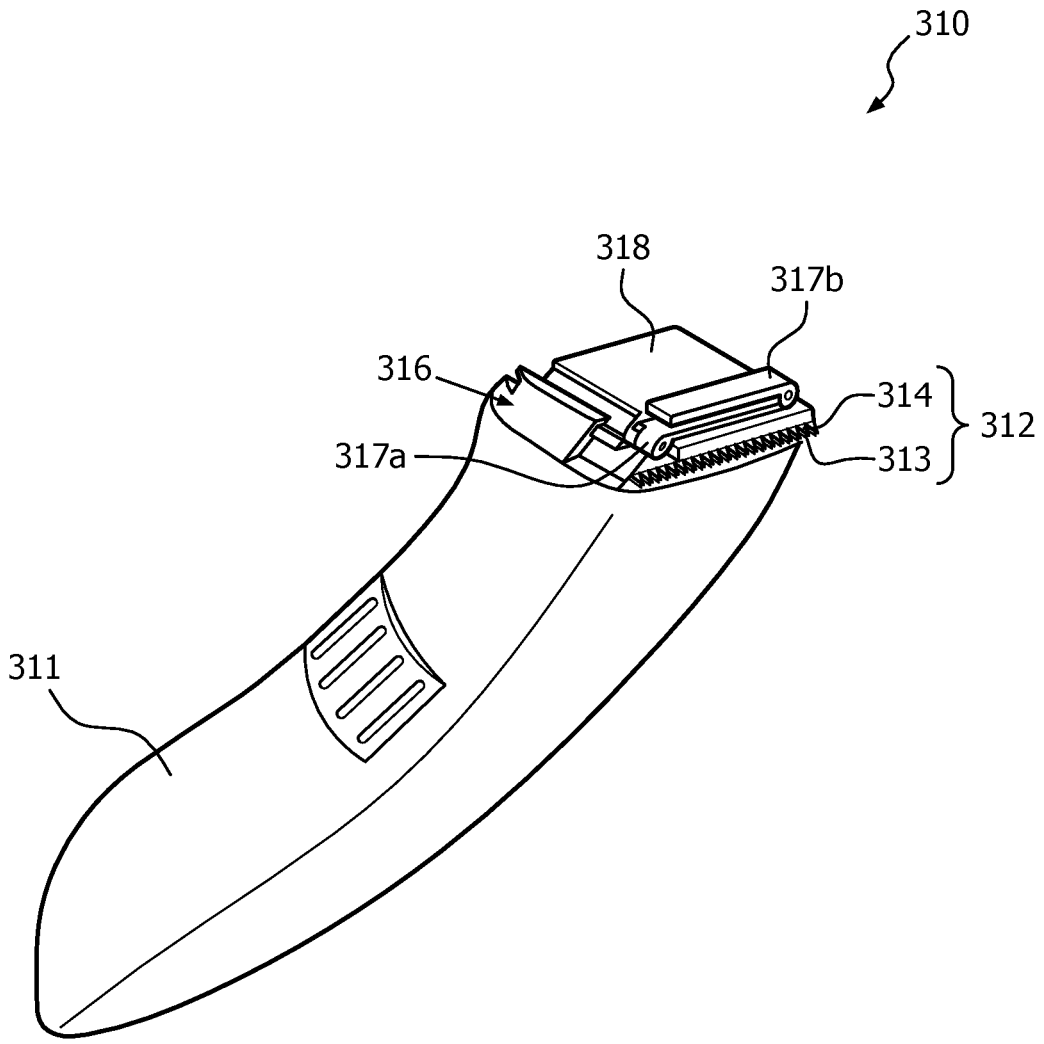
FIG. 10 shows a perspective view of a hair trimming device of a fourth embodiment of the invention.
Figure 11:
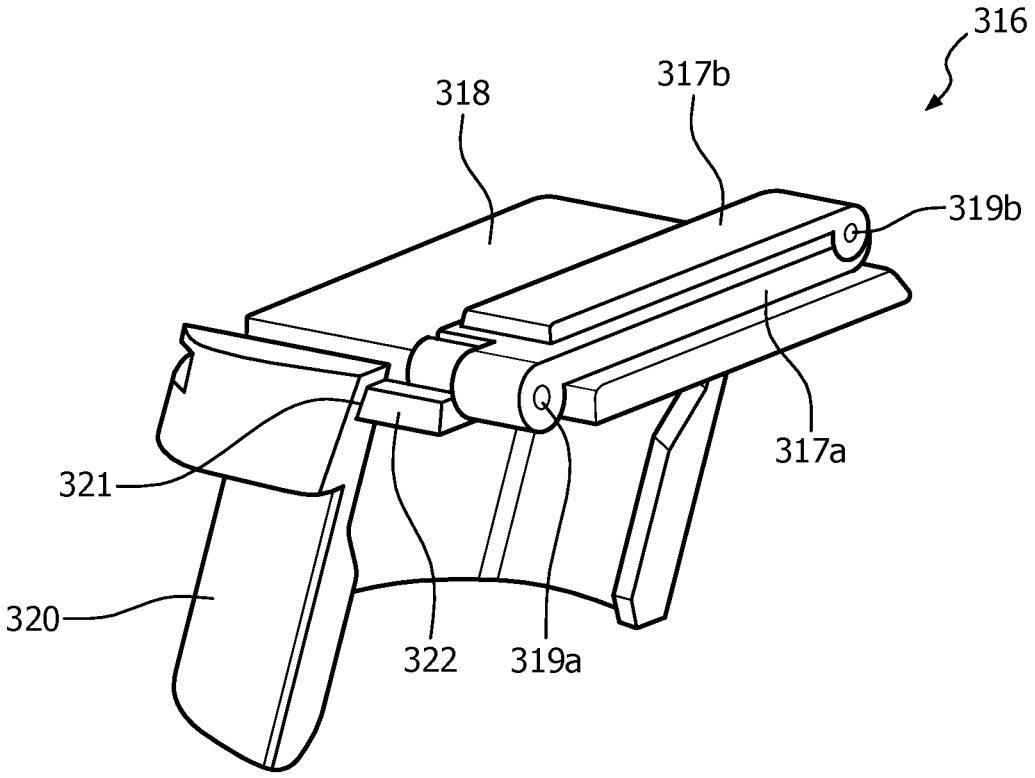
FIG. 11 shows a perspective view of the cutting guide of the device of FIG. 10.
Figure 12:
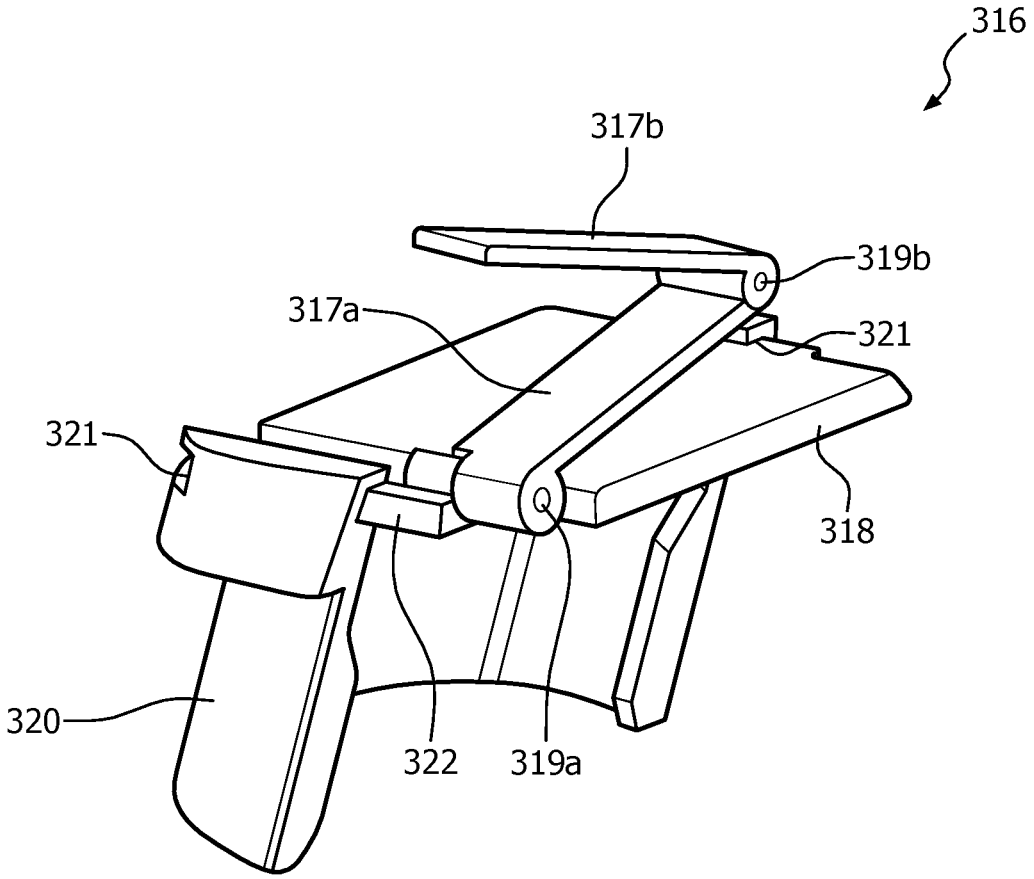
FIG. 12 shows the cutting guide of FIG. 11 in an extended angled position.

A device 310 for cutting hair according to a fourth embodiment of the invention is shown in FIGS. 10-12 and comprises a body portion 311 and a blade portion 312. The blade portion 312 comprises a fixed blade plate 313 and moving blade plate 314 as described previously and so a detailed description will not be repeated. A cutting guide 316 is provided which is shown in more detail in FIGS. 11 and 12, and comprises a first guide member **317*a* pivotally mounted to a support plate 318 at a first hinge portion 319*a*, and a second guide member 317*b* pivotally mounted by a second hinge portion 319*b* to the opposite end of the first guide member 317*a* to the first hinge portion 319*a*. The support plate 318 is detachably held in a holder 320 which itself is detachably secured at the end of the device 310 proximate the blade portion 312 (although it is intended within the scope of the invention that the holder 320 may be integrally formed with the device 310**).

The first guide member 317*a* is configured to pivot towards and away from the support plate 318 about the first hinge portion 319*a*, and therefore is pivotable relative to the blade portion 312. The second guide member 317*b* is configured to pivot towards and away from the first guide member 317*a* about the second hinge portion 319*b*. The first and second guide members 317*a*, 317*b* are shown in a collapsed state lying adjacent one another in FIG. 11, and are shown pivoted away from the support plate 318 and from each other in FIG. 12.

The holder 320 includes two opposing slots 321 which receive opposite side edges 322 of the support plate 318, and the support plate 318 can be retained in the holder 320 in a number of different orientations, in the same manner as described previously with respect to the third embodiment of the invention, so detailed description thereof will not be repeated here.

The cutting guide 316 including two pivotal guide members 317*a*, 317*b* provides the hair cutting device 310 with a greater range of cutting guide positions to enable a user to achieve a greater variety of hair cutting styles with accuracy. Also, as described previously with respect to the third embodiment of the invention, the support plate 318 being receivable in the holder 320 in a number of different orientations allows a user to cut hair at a desired style on one side of the face/body, reverse the orientation of the support plate 318, keeping the guide members 317*a*, 317*b* at the chosen angles, then accurately mirror the hair cut style on the other side of the face/body.

Figure 13:
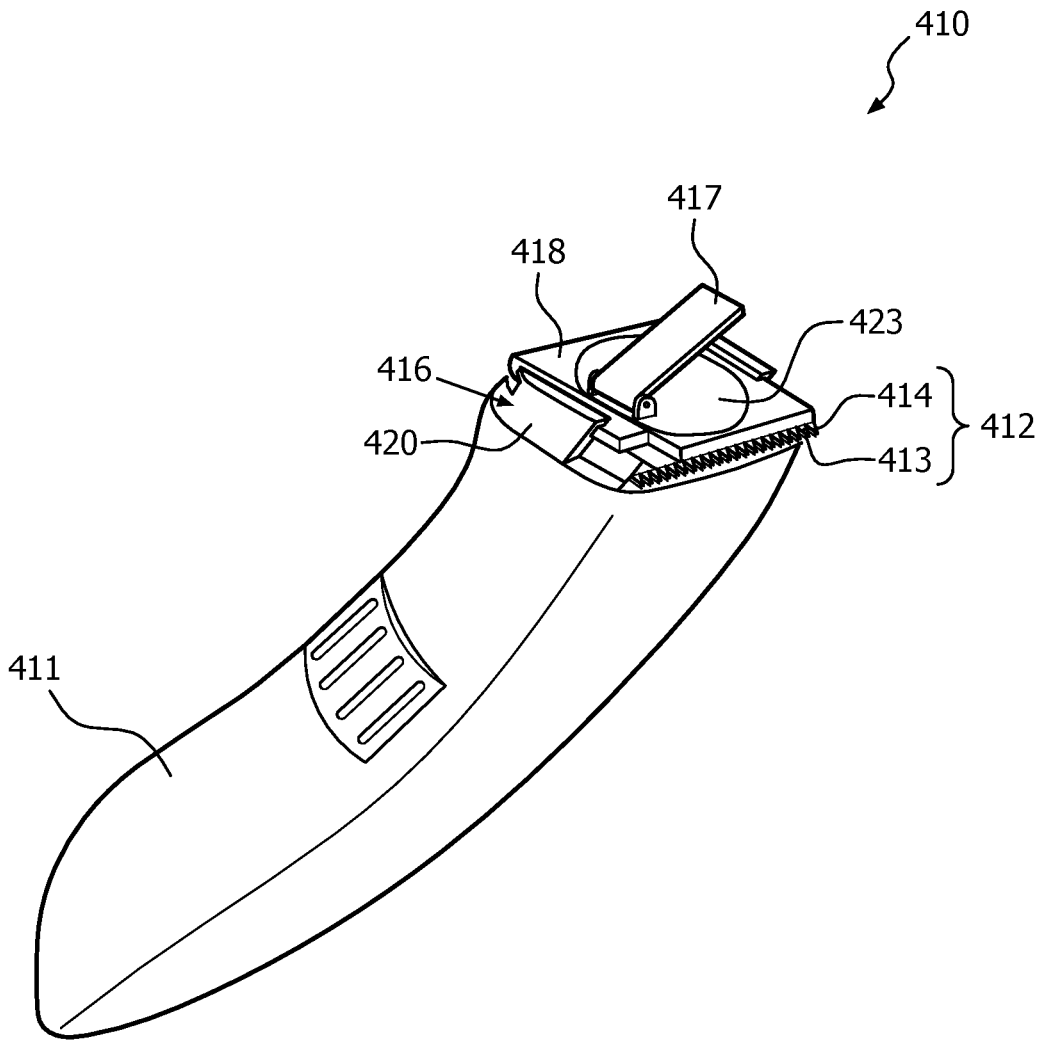
FIG. 13 shows a perspective view of a hair trimming device of a fifth embodiment of the invention.
Figure 14:
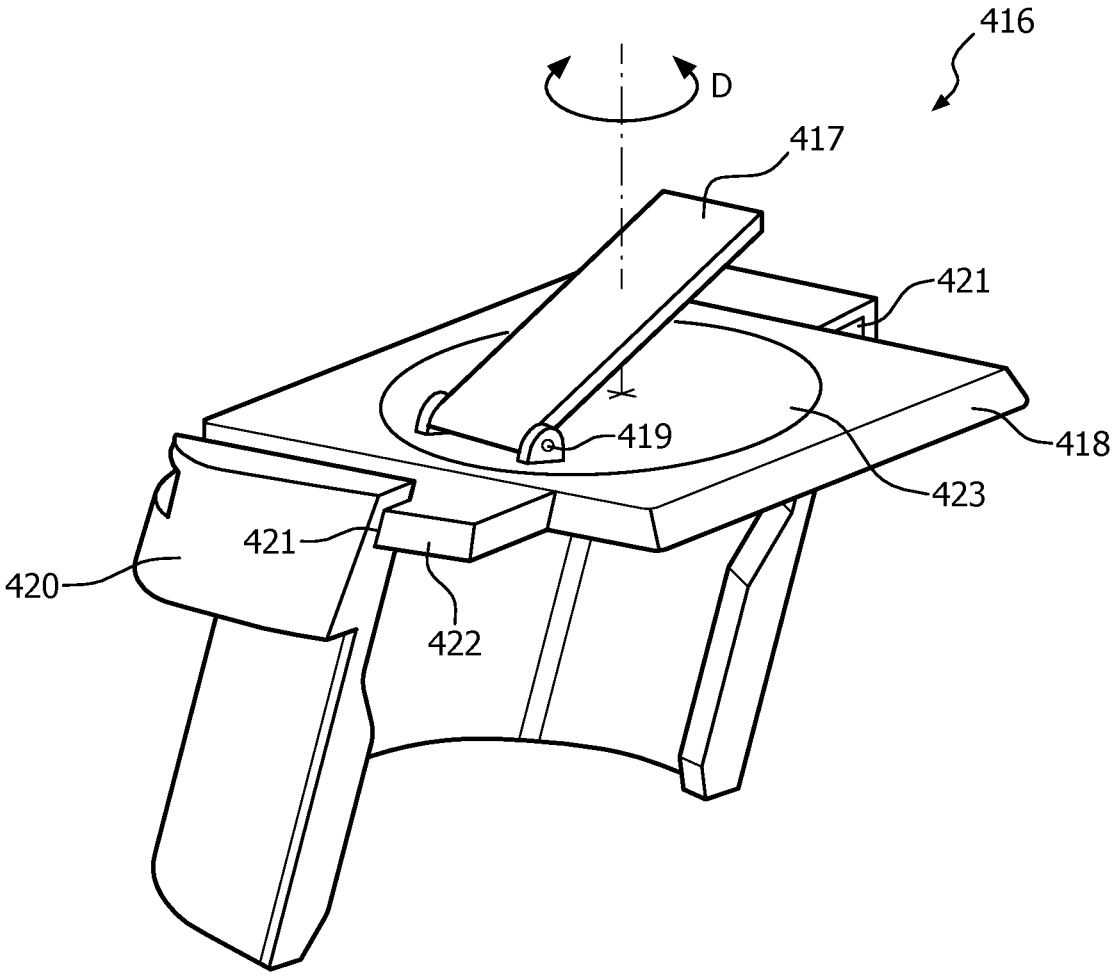
FIG. 14 shows a perspective view of the cutting guide of the device of FIG. 13.

A device 410 for cutting hair according to a fifth embodiment of the invention is shown in FIGS. 13 and 14 and comprises a body portion 411 and a blade portion 412. The blade portion 412 comprises a fixed blade plate 413 and moving blade plate 414 as described previously and so a detailed description will not be repeated. A cutting guide 416 is provided which comprises a guide member 417 pivotally mounted to a support plate 418 at a hinge portion 419, and the support plate 418 is detachably held in a holder 420. The holder 420 itself is detachably secured at the end of the device 410 proximate the blade portion 412 (although it is intended within the scope of the invention that the holder 420 may be integrally formed with the device 410). The support plate 418 includes a rotatable platform 423 and the guide member 417 is mounted on the rotatable platform 423. The guide member 417 is configured to pivot towards and away from the support plate 418 about the hinge portion 419, and therefore is pivotable relative to the blade portion 412. The guide member 417 is shown pivoted away from the support plate 418 in FIGS. 13 and 14. Furthermore, the platform 423 is configured to rotate about its central axis as shown by arrow D in FIG. 14, to enable the orientation of the guide member 417 relative to the blade portion 412 to be changed.

The holder 420 includes two opposing slots 421 which receive opposite side edges 422 of the support plate 418, and the support plate 418 can be retained in the holder 420 in a number of different orientations in the same manner as described previously with respect to the third embodiment of the invention, so detailed description thereof will not be repeated here.

The guide member 417 being rotatable on the support plate 418 allows a user to cut hair at a desired style on one side of the face/body, rotate the platform 423 and attached guide member 417, keeping the guide member 417 at the chosen angle, then accurately mirror the hair cut style on the other side of the face/body. It is intended that the feature of a rotatable platform 423 to rotate the guide member 417 relative to the rest of the hair cutting device 410, may equally be applied to the support plates 18, 218, 318 of the devices 10, 210, 310 of the first, third and fourth embodiments of the invention, to enable the guide members 17, 217, 317*a*/317*b* thereof to be rotatable relative to the rest of the respective device 10, 210 310.

The arm 17 of the device 10 of the first embodiment of the invention is described as being mounted to a support cover 18 which is detachable from the rest of the device 10. This has the advantage that a user can choose whether or not to use the cutting guide 16 and it can be removed when not being used. Similarly, the holders 220, 320, 420 of the devices 210, 310, 410 of the third to fifth embodiments of the invention are described as being removable from the rest of the device 210, 310, 410, providing the same advantage. However, it is intended within the scope of the invention that each of these the cutting guides 16, 216, 316, 416 may be formed integrally with the rest of the device 10, 210, 310, 410. Furthermore, the devices 210, 310, 410 of the third to fifth embodiments of the invention may include the holder 220, 320, 420 formed integrally with the device 210, 310 410, but when a cutting guide 216, 316, 416 is not required, the user can remove the detachable support plates 218, 318, 418. Yet further, it is intended that the support plates 218, 318, 418 may also be formed integrally with the device 210, 310, 410. In the device 110 of the second embodiment of the invention, it is intended within the scope of the invention that the first and/or second light sources 117, 118 of the cutting guide 116 may be formed integrally with, or be detachable from, the rest of the device 110.

The cutting guides of the various embodiments of the invention are adjustable so that the angular position of the cutting guide can be set to a chosen angle relative to the cutting blades of the blade portion, to provide a reference line for a hair cutting operation on a user's face. It is intended within the scope of the invention that the cutting guide may be adjustable from being parallel with the cutting blades to an angle spaced there from, for example, up to 180 degrees away from the cutting blades. However, it is also intended within the scope of the invention that the cutting guide may be adjustable to a range of chosen angles relative to the cutting blades except for an angle of zero degrees (i.e. parallel with the cutting blades). This may not be necessary as if the user wishes to cut hair parallel to the cutting blades, then no angular cutting guide is required and the user can simply use the cutting blades themselves as a reference guide.

It is intended that a hair cutting device of the invention may include a locking mechanism associated with the cutting guide to enable the cutting guide to be secured in a chosen position and to prevent the cutting guide moving from the chosen position during a hair cutting operation.

The hair cutting devices of the embodiments of the invention shown and described above generally comprise hair trimmers. However, it is intended within the scope of the invention that such devices may comprise shavers, for example electric rotary or reciprocal shavers, with a primary shaving head, and a secondary hair trimmer unit, and the blade portions with cutting guides of the invention may comprise the secondary hair trimmer units of such shavers.

While embodiments of the invention have been illustrated and described in detail in the drawings and foregoing description, such illustration and description are to be considered illustrative or exemplary and not restrictive, and the invention not limited to these embodiments. Furthermore, the scope of the invention in intended to encompass any combination of non-mutually exclusive features of the various embodiments of the invention shown and described above. For example, a hair cutting device of the invention may comprise two coupled guide members as with the device 310 of the fourth embodiment of the invention, mounted on a rotatable platform as with the device 410 of the fifth embodiment of the invention.

It will be appreciated that the term "comprising" does not exclude other elements or steps and that the indefinite article "a" or "an" does not exclude a plurality. The mere fact that certain features are recited in mutually different dependent claims does not indicate that a combination of these features cannot be used to an advantage and the invention is intended to include any combination of non-mutually exclusive features described herein. Any reference signs in the claims are not intended to be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived there from.

The invention claimed is:

1. A device for cutting hair comprising:

a body portion having a proximal end portion, an intermediate portion and a distal end portion, the body portion including a handle;

a cutting blade assembly located at the proximal end portion: and an adjustable cutting guide located at the intermediate portion, comprising a first light source and a second light source:

wherein the second light source is positioned in front of the first light source, the second light source being disposed closer to the proximal end portion:

wherein the position of the first light source of the cutting guide can be adjusted to a chosen angle (0, a) relative to the cutting blade assembly to provide a reference line on skin of a user to enable hair to be cut at said chosen angle relative to the reference line.

2. The device according to claim 1 wherein the first light source is pivotally mounted on the body portion and arranged to project a first an adjustable light beam onto the skin of the user at said chosen angle (6, a) relative to the cutting blade assembly as said reference line.

3. The device according to claim 2 wherein the first light source is incrementally rotatable with a plurality of set stable positions at chosen angular positions, to enable exact replication of cutting angle/orientation between separate uses of the device so that the angle (a) of the adjustable light beam relative to the cutting blade assembly can be adjusted to the chosen angle.

4. The device according to claim 3 wherein the second light source projects a fixed reference light beam in a direction parallel to the cutting blade assembly such that the adjustable light beam and the fixed reference light beam intersect at a single point to define a cross-hair reference point for a hair cutting operation.

5. The device according to claim 4, wherein the second light source is a laser light source.

6. The device according to claim 4, wherein the second light source of the cutting guide is formed integrally with the device.

7. The device according to claim 4, wherein the second light source of the cutting guide is detachable from the device.

8. The device according to claim 4 wherein the second light source is fixed relative to the cutting blade assembly.

9. The device according to claim 8, wherein the second light source is configured to project the fixed reference light beam onto the skin of the user beyond a cutting line where hair is cut by the cutting blade assembly.

10. The device according to claim 8 wherein the second light source is configured to project the fixed reference light beam onto the skin of the user at a cutting line where hair is cut by the cutting blade assembly.

11. The device according to claim 10 wherein said stable positions are provided symmetrically about a central zero set stable position at which the adjustable reference light beam lies parallel to the fixed reference beam.

12. The device according to claim 1, wherein the first light source is a laser light source.

13. The device according to claim 1, wherein the first light source of the cutting guide is formed integrally with the device.

14. The device according to claim 1, wherein the first light source of the cutting guide is detachable from the device.

15. The device according to claim 1, wherein the first light source of the cutting guide projects a beam comprising a reference shape including one or more angled surfaces.

16. The device according to claim 15, wherein the reference shape comprises a circle and the one or more angled surfaces comprise a sector of the circle, such that one line of the sector can be aligned with a reference feature on a face or a body of the user.

* * * * *